US005743835A

United States Patent [19]

Trotter

[11] Patent Number: 5,743,835

[45] Date of Patent: Apr. 28, 1998

[54] BICYCLE TREADMILL WITH SINGLE TURNTABLE

[76] Inventor: Edward E. Trotter, 4545 Gandy Blvd., Tampa, Fla. 33611

[21] Appl. No.: 853,086

[22] Filed: May 8, 1997

[51] Int. Cl.[6] ..... A63B 69/16

[52] U.S. Cl. ..... 482/57; 434/61

[58] Field of Search ..... 482/57, 61, 146, 482/58, 59, 60, 63, 64, 65; 434/61, 247

[56] References Cited

U.S. PATENT DOCUMENTS

| | | | |
|---|---|---|---|
| 584,989 | 6/1897 | Davis . | |
| 4,061,460 | 12/1977 | George | 425/459 |
| 4,593,898 | 6/1986 | McLerran et al. | 272/73 |
| 4,726,503 | 2/1988 | Bowker | 226/188 |
| 4,750,737 | 6/1988 | Smith | 272/73 |
| 4,802,666 | 2/1989 | Rodriqguez | 272/73 |
| 4,932,651 | 6/1990 | Defaux | 272/73 |
| 4,978,300 | 12/1990 | Letovsky et al. | 434/61 |
| 5,240,417 | 8/1993 | Smithson et al. | 434/61 |
| 5,413,545 | 5/1995 | Bermann | 482/71 |
| 5,492,516 | 2/1996 | Trotter | 482/57 |

*Primary Examiner*—Stephen R. Crow

*Attorney, Agent, or Firm*—C. Douglas McDonald Jr. & Associates, P.A.

[57] ABSTRACT

An exercise apparatus to which a bicycle may be attached for indoor training of cyclists. The apparatus includes a turntable rotatably mounted to a frame and a bicycle support device slidably connected to the frame for moving a bicycle along two axes in relation to the turntable. When a bicycle is mounted on the apparatus, the cyclist by turning the handlebars to the right or to the left in relation to the handlebars centered position, moves the support device forward or rearward and the contact point of the tire forward or rearward on the turntable. The first support becomes unstable in both the forward and rearward positions, moving the bicycle inwardly or outwardly, respectively, in relation to the turntable, increasing or decreasing, respectively, the moment arm of the force applied by the bicycle tire on the turntable as the bicycle is pedaled.

14 Claims, 12 Drawing Sheets

BICYCLE TREADMILL WITH SINGLE TURNTABLE

BACKGROUND OF THE INVENTION

1. Field of the Invention

The present invention relates to an exercise apparatus to which most bicycles may be attached for training and conditioning of cyclists.

2. Description of the Prior Art

Devices for holding a bicycle upright in a stationary position for use indoors or outdoors as exercise apparatus are well known in the art. Most such devices provide a means for applying adjustable resistance to one of the wheels of the bicycle in order to increase the force required to pedal and thereby obtain increased levels of exercise. The majority of such devices, for example, U.S. Pat. No. 4,493,898 issued to McLerran, et al., U.S. Pat. No. 4,802,666 issued to Michael Rodriguez, and U.S. Pat. No. 584,989 issued to Isaac Davis, each disclose a method for increasing the resistance to rotation of the rear tire of a bicycle. These methods include, respectively, changing the length of the moment arm when the bicycle tire is applied to a vertical rotatable disc, increasing or decreasing the force of a brake mechanism applied to a roller on which the bicycle rides and adding weight to a rotating platform. Each of these exercise devices require the operator to dismount from the bicycle to make the adjustment to the resistance.

U.S. Pat. No. 4,932,651 issued to Georges Defaux discloses a device that has a handle located near the pedals that must be rotated to increase the upward force of the rollers against the tire. This device requires the cyclist to disengage at least one hand from the handlebars to make such an adjustment. Cyclists, when training desire to simulate the actions of riding a bicycle outdoors as closely as possible.

U.S. Pat. No. 5,492,516 issued to Edward Trotter discloses an apparatus comprising two turntables that are rotatably connected to a frame and to one another for simultaneous rotation. A bicycle is mounted to a support that is slidably attached to the frame for movement between the turntables. By turning the front wheel of the bicycle, the support moves inwardly or outwardly between the discs carrying the bicycle inwardly or outwardly on the discs providing increased or decreased levels of exercise. Two steel discs make the apparatus too heavy and too bulky for easy use in the home.

Therefore, not withstanding the existence of such prior art, it remains clear that there is a need for an exercise apparatus that is used with a bicycle to permit the rider to sit upon the bicycle and have total variability of workloads during training without having to dismount or remove his or her hands from the handlebars and yet have the apparatus small enough and portable enough to be used in the home.

SUMMARY OF THE INVENTION

The present invention comprises an exercise apparatus that simulates the experience of riding a bicycle outdoors, including the capability of varying the workload without removing the hands from the handlebars. Workload may be changed to simulate hills of varying height or length, wind resistance, and overcoming the inertia of the weight of the bicycle. As the speed of the bicycle, and thus, the speed of the turntable increases, the work load increases.

The exercise apparatus of this invention is used in combination with a bicycle having a tubular structure, a handlebar that is connected to a front fork that is mounted to the tubular structure and a rear wheel that is also mounted to the tubular structure. The exercise apparatus comprises a turntable that is rotatably mounted to a frame, a base that is attached to the frame adjacent to the turntable for movement along a first path between a first stop position and a second stop position and a carriage that is attached to the base for movement on the base along a second path. A first support is attached to the carriage for movement with the carriage. The first support is configured for attachment of at least a portion of a bicycle thereto so that when a bicycle is mounted on the first support the rear wheel of the bicycle is engagable with the turntable. The exercise apparatus further comprises means for moving the carriage along the second path between a first unstable position and a second unstable position. The support is also positionable at a stable position that lies along the second path between the first unstable position and the second unstable position.

By pedaling, a cyclist rotates the rear tire causing the turntable to rotate. The inertia of the turntable and resistance created by air moving through fan blades attached to the turntable are overcome by the cyclist as he or she strives to reach a targeted speed. The carriage is moved along the second path by the cyclist toward the first unstable position. When the first support is in the first unstable position the base will move inwardly along the first path so that the bicycle tire approaches the center of the turntable. When the first support is in the second unstable position, the base will move outwardly along the first path so that the bicycle tire approaches the circumferential edge of the turntable. When the rear tire of the bicycle moves inwardly on the turntable, the moment arm of the force applied to the turntable by the bicycle is reduced increasing the pedaling effort required by the cyclist to maintain the same rate of rotation of the bicycle wheel. Rotating the turntable faster moves more air through the fan blades, which also increases the effort required by the cyclist and simulates riding the bicycle up an incline or the energy required to overcome head winds. Conversely, as the base moves outwardly away from the center of the turntable the cycling effort is decreased. The cyclist also benefits from the inertia of the turntable which keeps the bicycle wheels rolling without pedaling, similar to coasting along a flat area of track or road.

DESCRIPTION OF A PREFERRED EMBODIMENT

Figure 1:
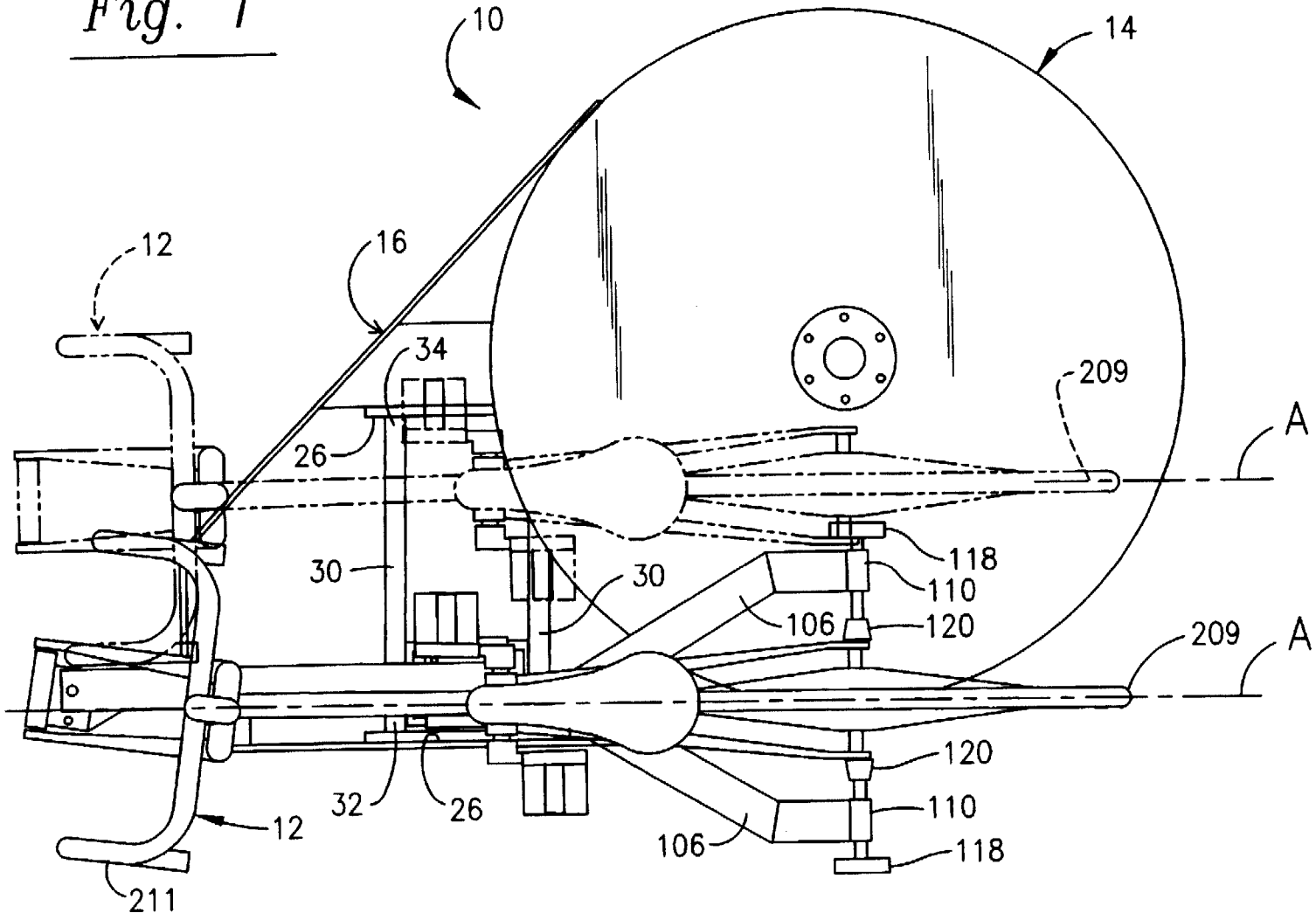
FIG. 1 is a plan view of the exercise apparatus of this invention illustrating a bicycle mounted thereon in a first position and in phantom in a second position.

A preferred embodiment for the exercise apparatus of this invention is illustrated in the drawing FIGS. 1–15 in which the exercise apparatus is generally indicated as 10. For purposes of illustration, portions of a bicycle, generally indicated as 12, are illustrated as being attached to the exercise apparatus 10 in FIGS. 1, 2, and 4–7. Referring first to the views of FIGS. 1 and 2, it can be seen that the exercise apparatus 10 comprises a turntable 14, a frame 16, a base 18, a carriage 20 and first and second supports 22 and 24 respectively. The frame 16 is comprised of a plurality of structural members 26 to which are attached a plurality of adjustable feet 28 for leveling the frame 16 when placed on an uneven floor. As shown in FIGS. 1, 8, 11 and 12, the frame 16 comprises a pair of guides 30 that each have a first end 32 and a second end 34 that are attached to the frame 16.

Figure 11:
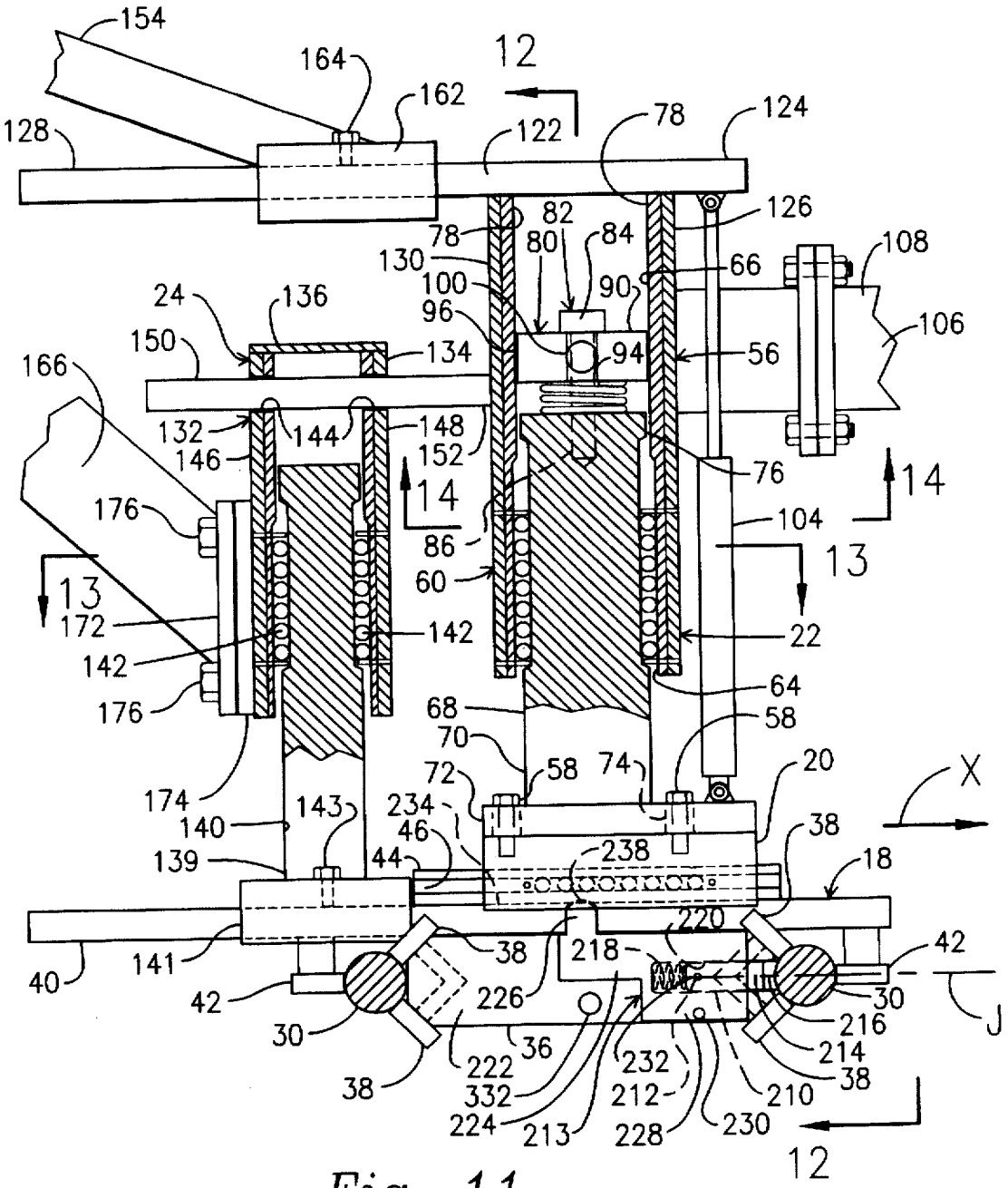
FIG. 11 is a detailed, partial cross-sectional, front elevational view of the invention of FIG. 1, illustrating the first and second support, the carriage and the base mounted to the frame.
Figure 12:
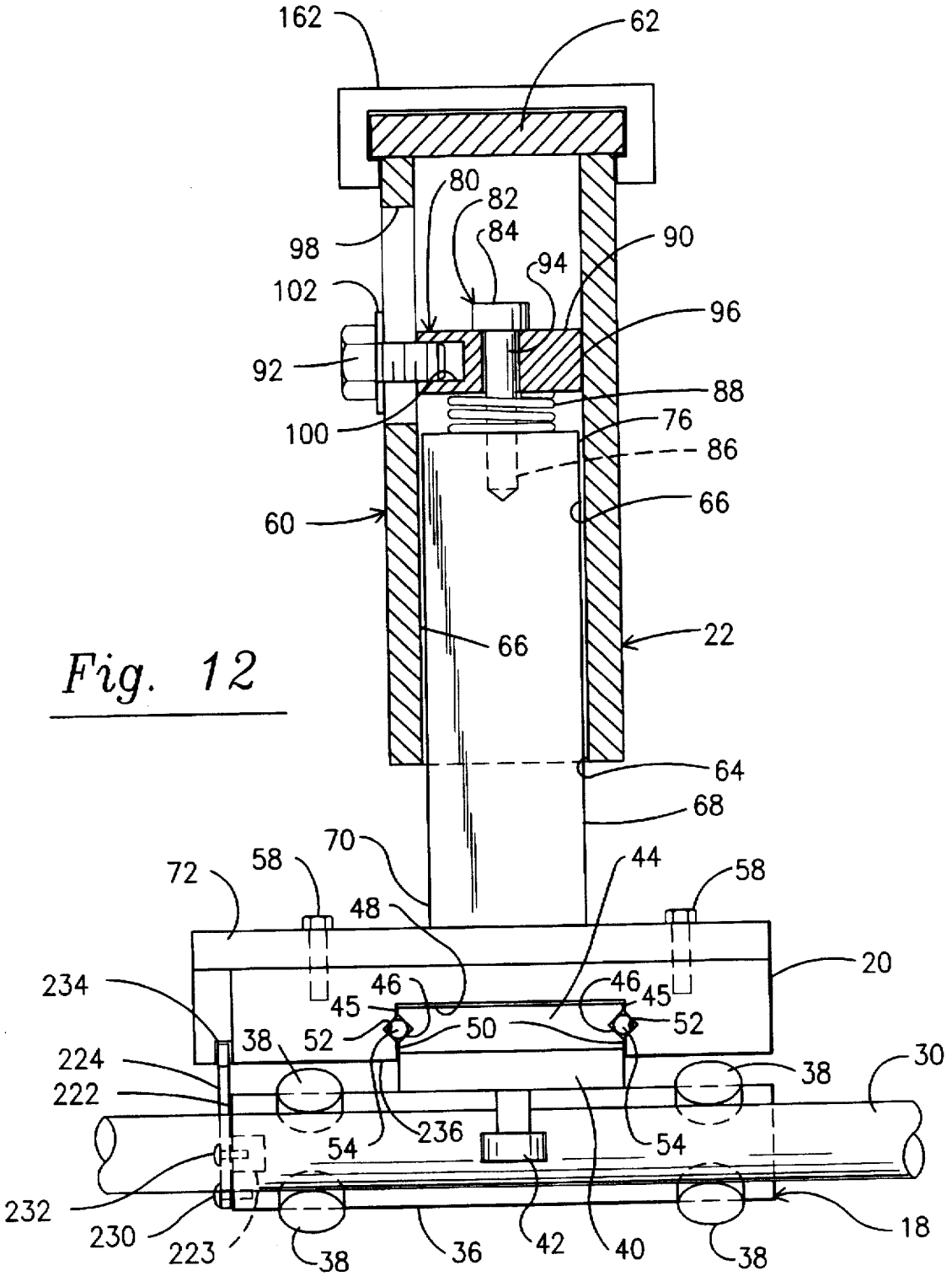
FIG. 12 is a detailed cross sectional view taken along line 12—12 of FIG. 11.
Figure 13:
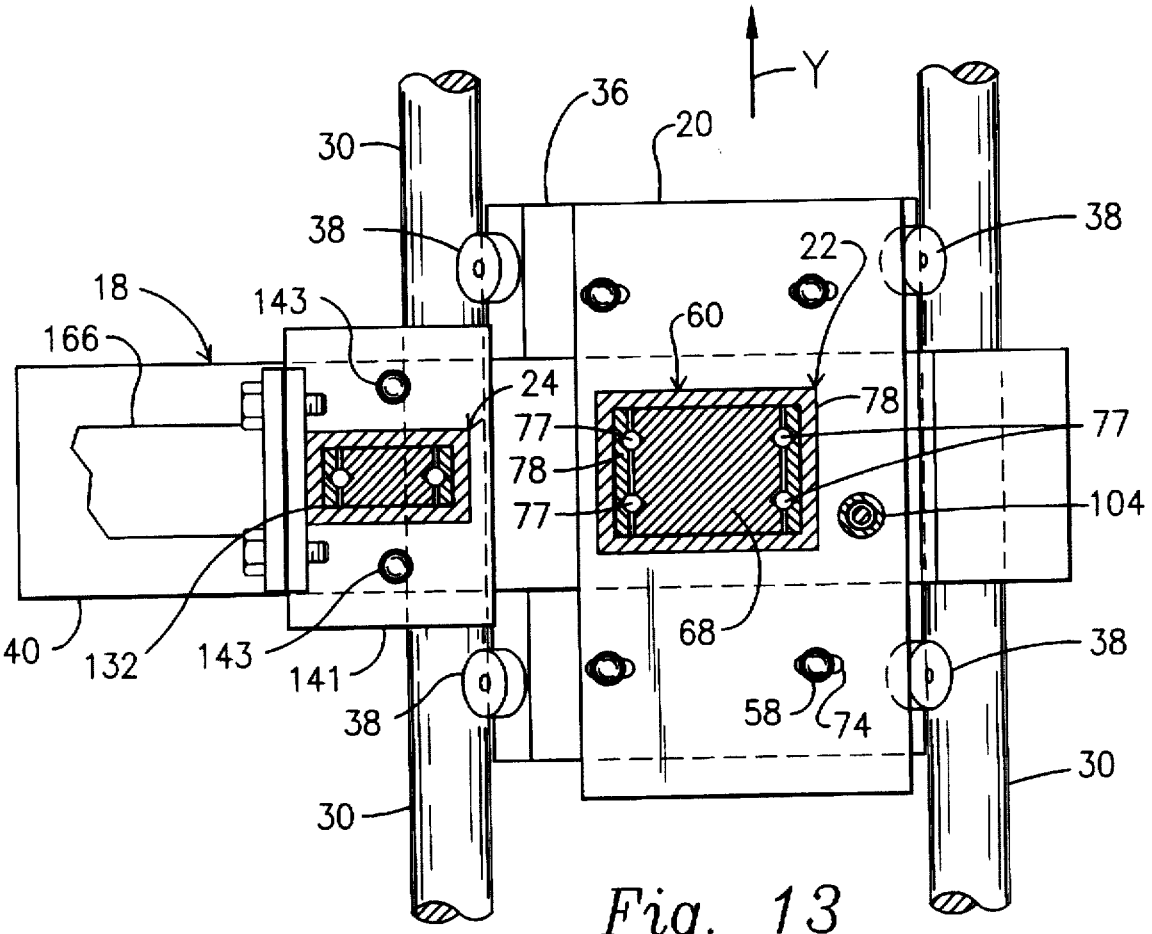
FIG. 13 is a cross sectional plan view taken along line 13—13 of FIG. 11.

As seen more clearly in FIGS. 11, 12 and 13, the base 18 is mounted on guides 30 for movement thereon. In a preferred embodiment, the base 18 of the exercise apparatus 10 further comprises a body 36 to which are attached eight (8) wheels 38 for rolling engagement with the guides 30. In a preferred embodiment, the guides 30 comprise a pair of longitudinally extending cylindrical rails that are engaged by the wheels 38. In other embodiments, the guides 30 may be a flat surface upon which the base moves or any other structure suitable for movement of one body in relation to another that is known in the art. The base 18 is free to move along the guides 30 defining a first path identified as Y. The base 18 may move outwardly in relation to the center of the turntable 14 until the base reaches the first ends 32 of the guides 30, defining a first stop position. The base 18 may move inwardly, in the opposite direction, until the base 18 reaches the second ends 34 of the guides 30 and the frame 16, defining a second stop position.

A beam 40 is attached to the base by bolts (not shown), by welding, or other suitable methods, and extends longitudinally outwardly at generally right angles to the first path Y. For purposes of stability, as shown in FIG. 11 and 12, two wheels 42 are attached to the beam 40 on opposing sides of the body 36 so that the wheels 42 engage the adjacent guide 30. As seen in FIGS. 11 and 12, a track 44 is attached to a surface of the beam 40, by bolting, welding or any other well known means. The track 44 extends generally longitudinally parallel to the beam 40. The opposing sides 45 of the track 44 have a pair of grooves 46 formed therein.

As best seen in FIG. 12, the carriage 20 is slidably mounted on the track 44 for movement along the track 44 defining a second path X that is generally at right angles to the first path Y. The carriage 20 has a recess 48 formed therein that is sized and configured to receive the track 44. The sides 50 of the recess 48 have grooves 52 formed therein that oppose the grooves 46 formed in the track 44 so that ball bearings 54 may be inserted between the grooves 46 and the adjacent grooves 52, forming linear bearings, for free movement of the carriage 20 on the track 44.

The first support 22 is mounted on the carriage 20 by bolts 58 for movement of the first support 22 along the first path Y and along the second path X. The first support 22 comprises a member 60 that has a first end 62 that is closed, a second end 64 that is open, an interior surface 66 and a post 68. The post 68 has a first end 70 that is attached to a plate 72 for mounting to the carriage 20 by the bolts 58. The holes 74 through the plate 72 are elongated to permit fine adjustment of the location of the first support 22 in relation to the carriage 20. The post 68 has a second end 76 that is sized and configured to be received by the open second end 64 of the member 60. In a preferred embodiment, as illustrated in FIGS. 11 and 13, four linear bearings are inserted between the post 68 and the member 60 for free movement of the member 60. Linear bearings are well known in the art and may be constructed similar to those used between the carriage 20 and the track 44. For ease of manufacture, the member 60 may be made from tubular steel with two bearing plates 78 inserted into member 60 and attached to opposing interior walls. The bearing plates 78 and the post 68 are configured to receive the linear bearings 77 therebetween. In other embodiments, prefabricated linear bearings, or other types of bearings may be obtained and installed by those skilled in the art.

A locking mechanism 80 is attached to the first end 76 of the post 68. The locking mechanism 80 comprises a bolt 82 having an expanded first end 84 and a threaded second end 86, a biasing means, conveniently spring 88, a collar 90 and a locking bolt 92. The collar 90 is slidably mounted on the shank 94 of the bolt 82 adjacent the first end 84 and the spring 88 is then mounted on the shank 94 so that when the bolt is threadably attached to the first end 76 of the post 68 the spring 88 lies between the collar 90 and the first end 76 of the post 68. The collar is sized and configured so that the circumferential edge 96 lies closely adjacent to the interior surface 66 of the member 60 and the bearing plates 78. The bolt 92 is inserted through an elongated slot 98 and is threadably received by the hole 100 in the collar 90. A washer 102 is inserted between the bolt 92 and the member 60 in order to span the slot 98. When the bolt 92 is loose the body 60 may slide freely upon the post 68. So that this movement is easily done by the user with a bicycle 12 mounted on the apparatus 10, a gas spring 104 is attached to the base plate 72 at one end and to the first end 62 of the body 60 at the other end. The gas spring 104 is designed to support the weight of a typical bicycle 12 so that the body 60 may be positioned easily on the turntable 14. With a bicycle 12 mounted on the apparatus 10, the body 60 is lowered on the post 68 until the tire 209 of the bicycle 12 contacts the turntable 14. The locking bolt 92 is then tightened so that the collar 90 is pulled into tight engagement with the interior surface 66 of the body 60, frictionally preventing movement of the body 60 in relation to the collar 90. The body 60 is now constrained to move within the limits permitted by the spring 88. When the additional weight of a rider is added to the weight of the bicycle 12, this weight will overcome the strength of the spring 88 and the gas spring 104 so that the spring 88 is totally compressed and the body 60 reaches a bottom position. The spring is sized to provide an extra ⅜ of an inch of downward movement so that the tire 209 fully engages the turntable 14.

The lifting device 292, to be discussed later, can then apply an upward force to the turntable 14, which in a preferred embodiment engages the tire 209 with sixty pounds of force.

Figure 2:
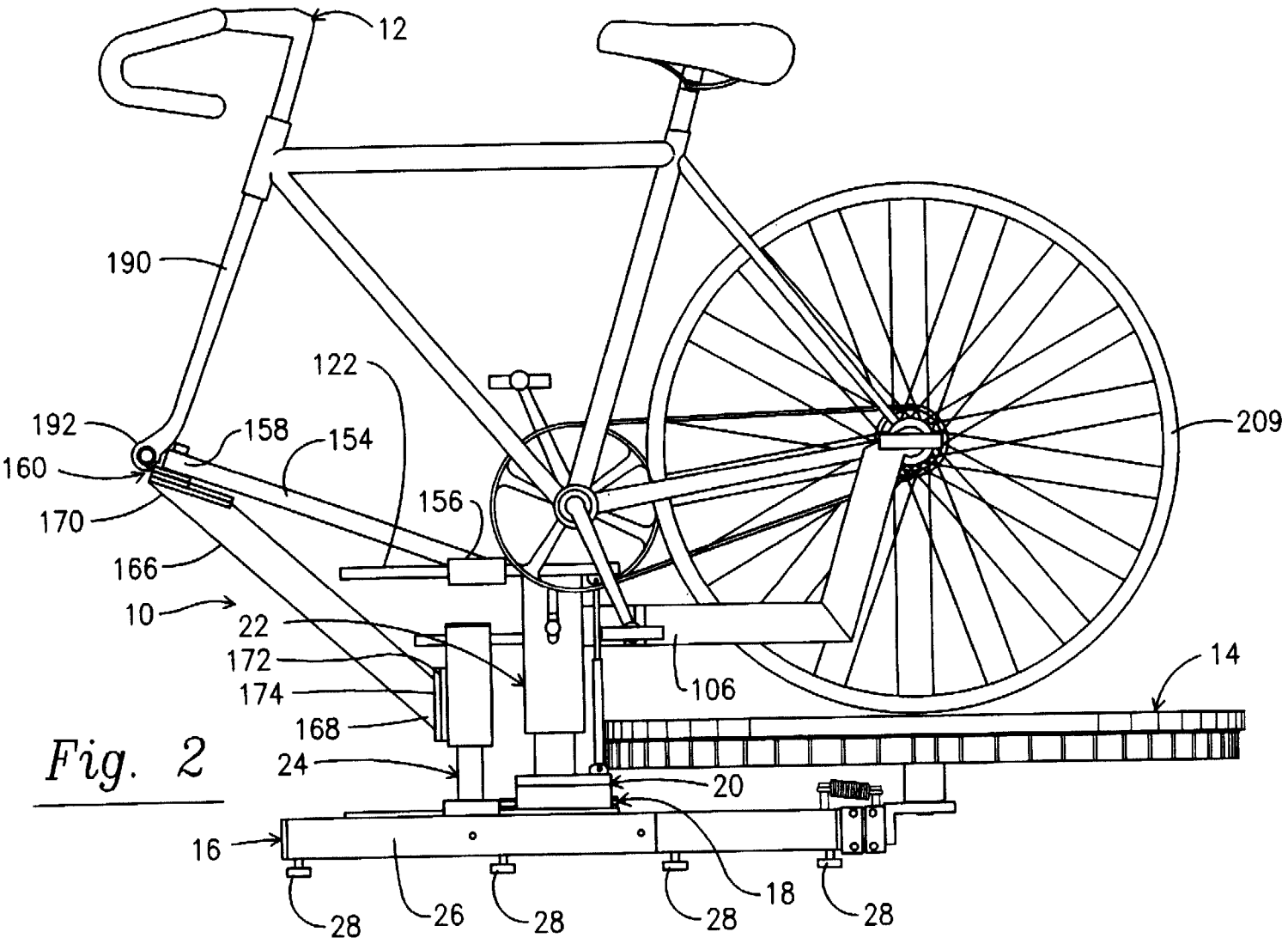
FIG. 2 is a front elevation view of the invention of FIG. 1.
Figure 14:
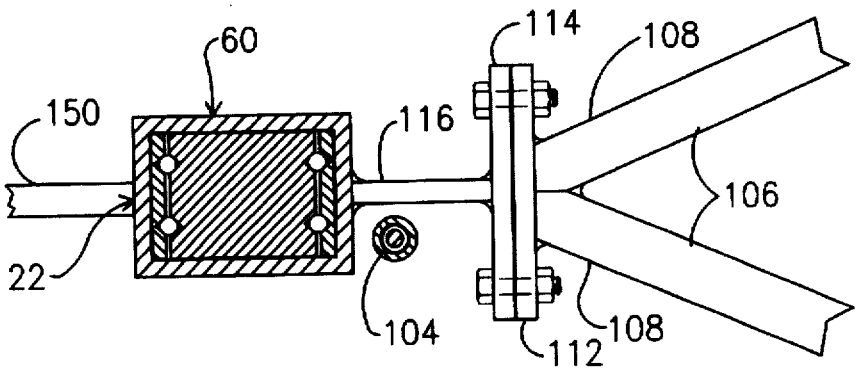
FIG. 14 is a cross sectional plan view taken along line 14—14 of FIG. 11.

As shown in FIGS. 1, 2 and 14, two arms 106 each having a first end 108 and a second end 110 are connected to the member 60 and provide support to the rear axle of the bicycle 12. The first end 108 of these arms may be welded to the member 60 or in the preferred embodiment illustrated in FIG. 14, the first end 108 of each arm 106 is welded to a first flange plate 112, which is bolted to a second flange plate 114, which is then welded to a spacer 116 that is welded to the member 60. As seen most clearly in FIG. 1, the second end 110 of each arm 106 has a T-bolt 118 threadably mounted thereon so that a cup shaped receptor 120 on each end of the T-bolt 118 can capture the wheel nuts (not shown) of the bicycle, thereby supporting the axle of the bicycle 12 for engagement of the bicycle tire 209 with the turntable 14 of the exercise apparatus 10.

As shown in FIG. 11 the body 60 also comprises a bar 122 that is attached to the first end 78 of the body 60 and extends outwardly therefrom at generally right angles to the first path Y and longitudinally parallel to the track 44 and the second path X. The bar 122 has a first end 124 that extends sufficiently beyond the first side 126 of the member 60 for attachment of one end of the gas spring 104 thereto. The second end 128 extends outwardly beyond the opposing second side 130 of the member 60 and remains free.

As can be seen in FIG. 11 and FIG. 13 the second support 24 is constructed in a manner similar to the first support 22. The second support 24 comprises a column 140 and sleeve 132 that has a first end 134 that is closed by plate 136 and has an open end 138. The sleeve 132 is mounted on the column 140 in a similar fashion to the method of mounting the body 60 on to the post 68. In this case, since the second support 24 is smaller than the first support 22, only two sets of linear bearings 142 are required to maintain free movement of the sleeve 132 on the column 140. The linear bearings 142 may be constructed in the same fashion as those used in the first support 22 or may comprise prefabricated bearings to be installed by those skilled in the art. A hole 144 is formed through opposing sides 146 and 148 of the sleeve 132. A connector, conveniently rod 150, interconnects the first support 22 with the second support 24. The rod 150 is inserted through the hole 144 through the sleeve 132 and the first end 152 of the rod 150 is attached to the second side 130 of member 60.

As can be seen in FIG. 2 a first strut 154 has a first end 156 that is connected to the first support 22 and a second end 158 that is attached to an actuator 160. The first end 156 is attached to a slidable clamp 162 that is adjustably attached to the bar 122. A bolt 164, as seen in FIG. 11, may be tightened to hold the clamp 162 in a predetermined position or it may be released for slidable adjustment on the bar 122.

Further in FIGS. 11 and 13, it can be seen that the first end 139 of the column 140 is attached to a column clamp 141 that is slidably mounted on the beam 40 for slidable adjustment. The clamp 141 is locked in position on the beam 40 by tightening a pair of bolts 143 when the column clamp 141 is properly located on the beam 40.

As can be seen in FIGS. 2 and 11, a second strut 166 has a first end 168 and a second end 170. A first flange 172 is attached by welding or other well known means to the first side 146 of the sleeve 132. A second flange 174 is attached to the first end 168 of the second strut 166 by welding or other means. The flanges 172 and 174 are then bolted to one another by bolts 176 thereby attaching the second strut 166 to the sleeve 132. The second end 170 of the second strut 166 is attached to the actuator 160 by welding or other well known means.

Figure 3:
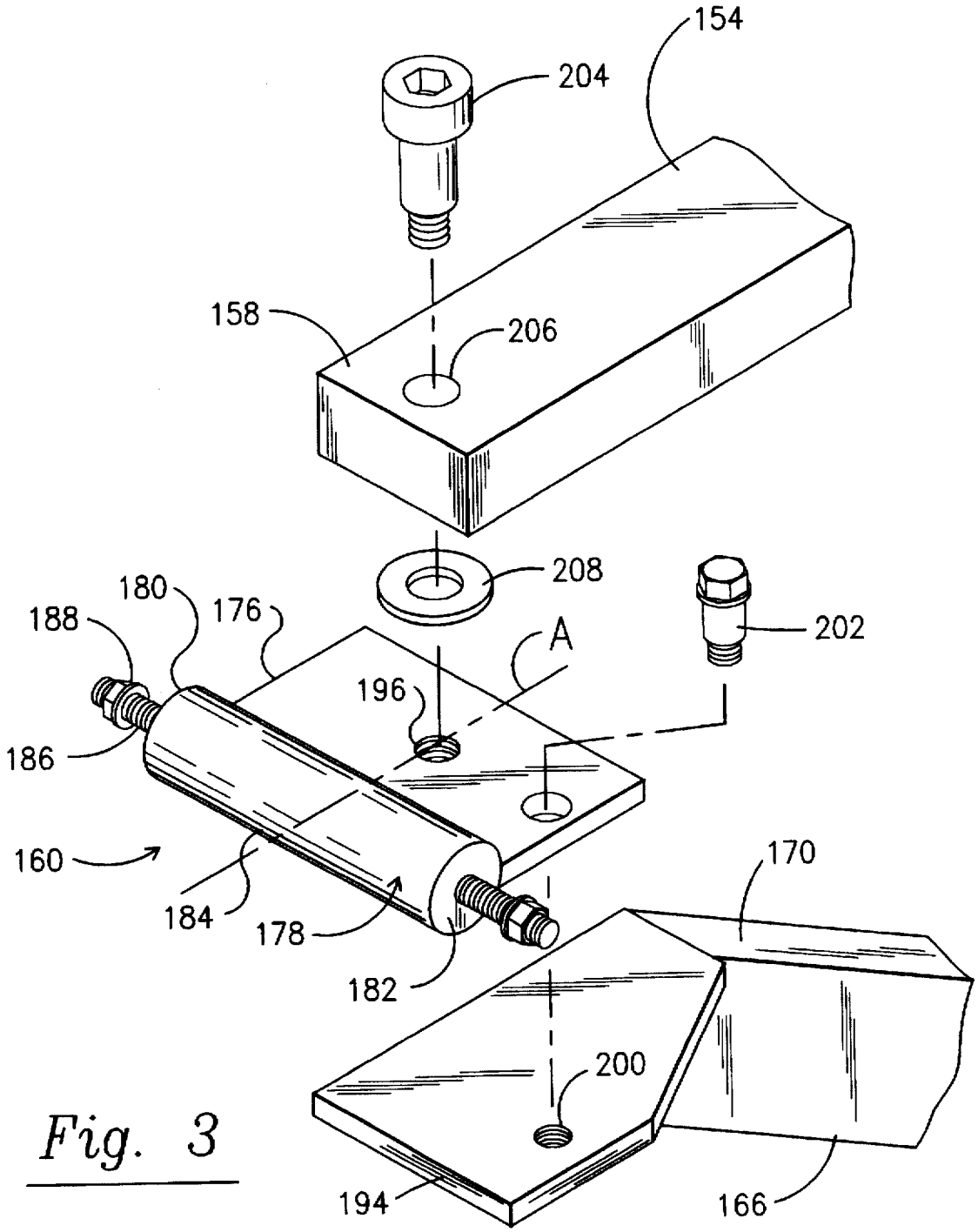
FIG. 3 is a detailed exploded view of the actuator of this invention.
Figure 4:
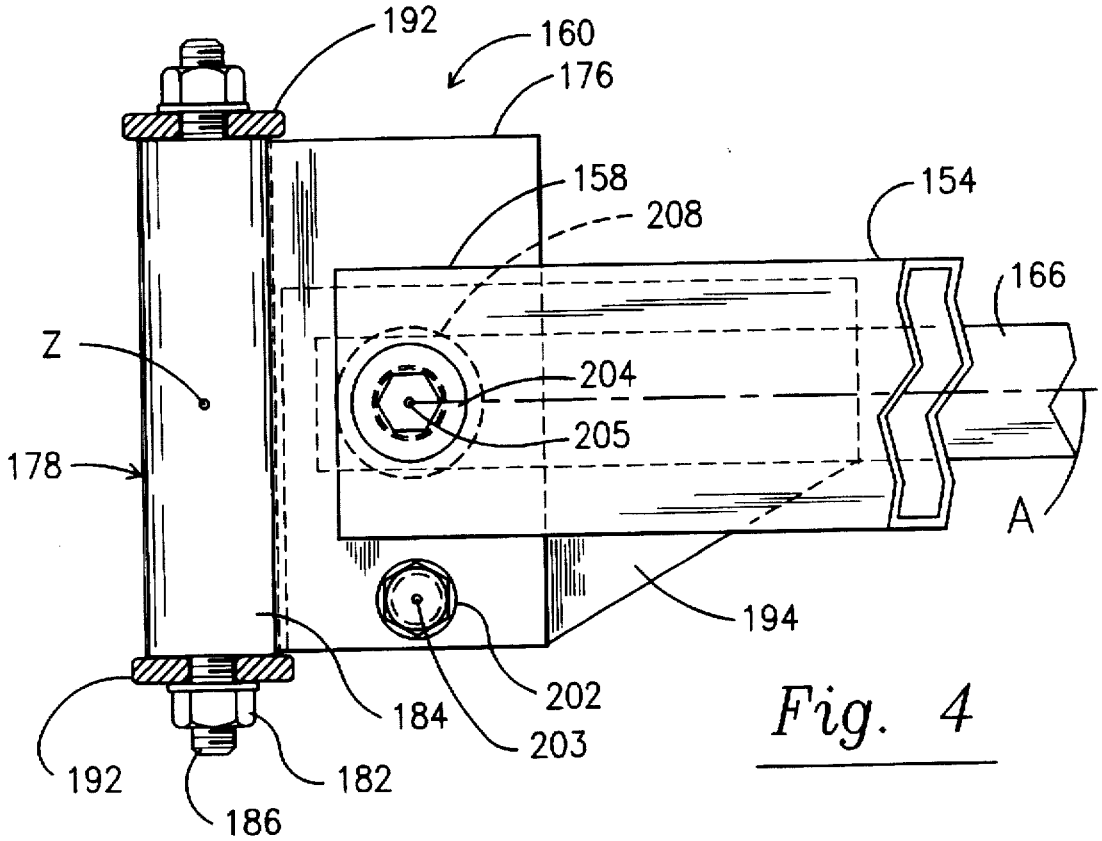
FIG. 4 is a plan view of the actuator of FIG. 3 illustrating the front forks of a bicycle mounted thereon.
Figure 5:
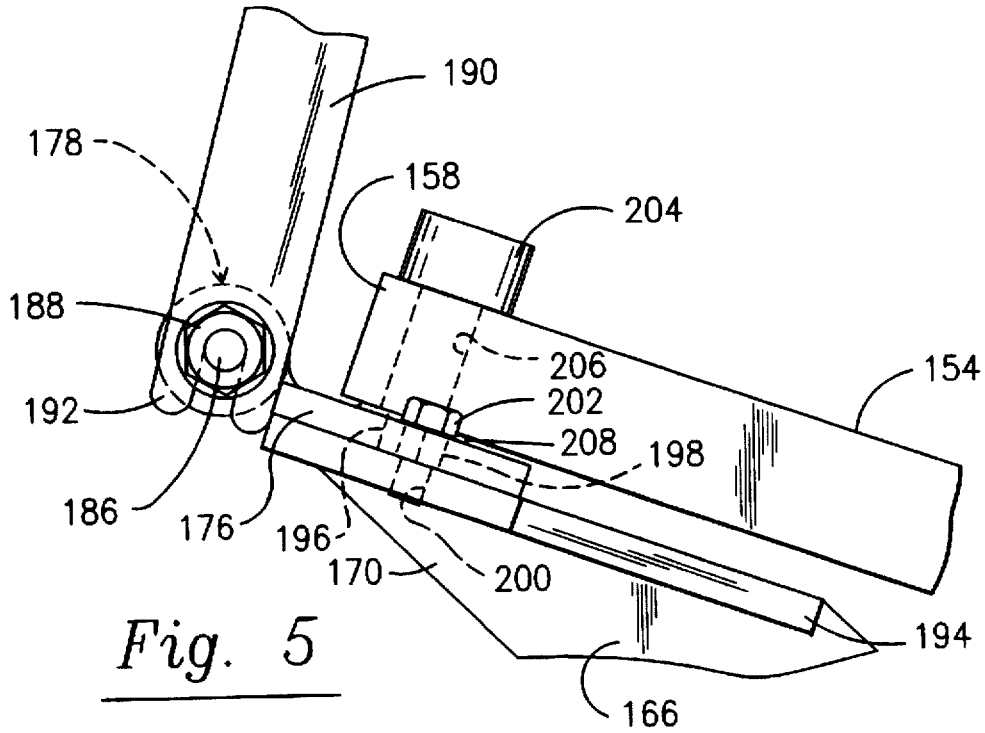
FIG. 5 is a front elevational view of the detail of the invention shown in FIG. 4.

The actuator 160 can be clearly seen in FIGS. 3–7. The actuator 160 comprises a first plate 176 to which the front fork 190 of bicycle 12 can be attached. For ease of attachment, in the preferred embodiment, a spacer 178 having a first end 180 and a second end 182 is attached to the plate 176. The spacer 178 may be cylindrical with a plurality of sides or a single side as shown in FIG. 3. One longitudinal edge (not shown) of the first plate 176 is attached to the side 184 of the spacer 178 by welding or other well known means. To each of the ends 180 and 182 of the spacer 178 are attached a threaded shaft 186 with a nut 188 threadably mounted thereon. As shown in FIG. 2 and more clearly in FIGS. 4 and 5 the ends of the fork 190, the drop outs 192, are mounted to a respective shaft 186 on opposing ends of the spacer 178 and the nuts 188 tightened so that the fork 190 is firmly attached to the actuator 160 of the apparatus 10. The actuator 160 further comprises a second plate 194 that is attached by welding or other well known means to the second end 170 of the second strut 166. A pair of holes are bored through the first plate 176 with the first hole 196 being threaded and being formed generally on the center line A of the bicycle 12 when the bicycle 12 is mounted on the apparatus 10 and the fork 190 and handlebars 211 are centered, that is, are aligned for travel of the bicycle 12 along a straight line. The second hole 198 is offset from the first hole 196 and is smooth bored. Second plate 194 has a threaded hole 200 formed therein for receipt of the threaded portion of a first shoulder bolt 202 after the bolt 202 has been inserted through the hole 198 in the first plate 176. The first plate 176 is now pivotally attached to the second plate 194 at a second pivot point 203. A second shoulder bolt 204 is inserted through a hole 206 in the second end 158 of the first strut 154, then through a washer 208 and is threadably attached to the hole 196 in the first plate 176 at a first pivot point 205.

Figure 6:
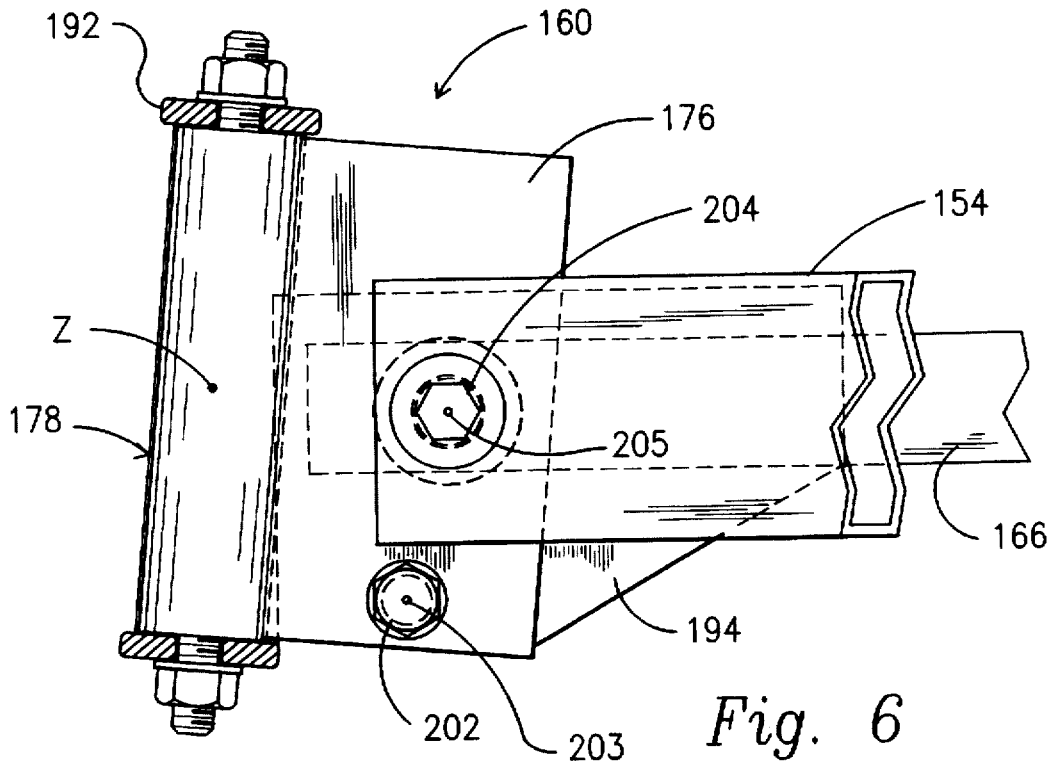
FIG. 6 is a detailed view of the invention as shown in FIG. 4 illustrating the rotation of the bicycle fork in a clockwise direction.
Figure 7:
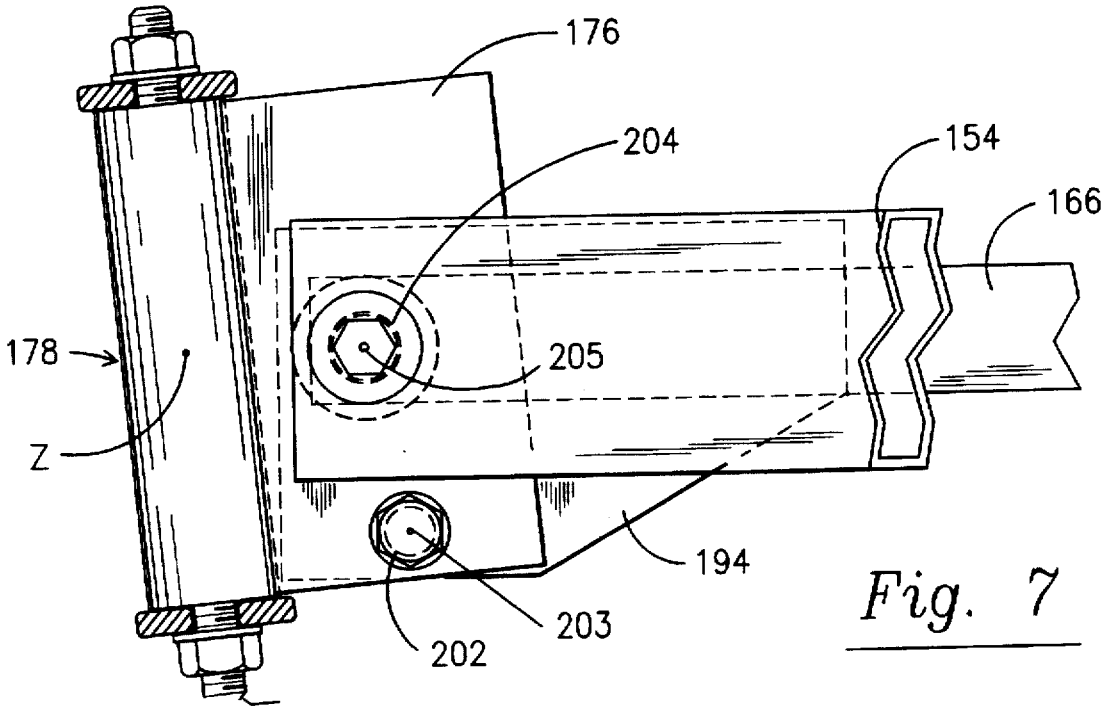
FIG. 7 is a detailed view of the invention as shown in FIG. 4 illustrating the rotation of the bicycle fork in a counter clockwise direction.

Rotation of the handlebars 211 rotates the fork 190 about its longitudinal axis Z, pivoting the first plate 176 about the shoulder bolt 202. As long as the second plate 194 remains stationary, pivoting the first plate will create movement in the first strut 154. The second plate 194 will remain stationary as long as the bolts 143 of the column clamp 141 are tight (see FIG. 11), locking the column clamp 141 to the beam 40. Rotation of the fork 190 to the left, as shown in FIG. 7, will cause the first plate 174 to move the strut 154 in the forward direction moving the first support 22 along the track 44 away from the turntable 14 along the second path X. Rotation of the fork 190 to the right, as shown in FIG. 6, will cause the first plate 174 to move the strut 154 in the rearward direction moving the first support 22 along the track 44 toward the turntable 14 along the second path X. The track 44 is sufficiently long enough so that the carriage 20 remains on the track 44 at the maximum points of rotation of the fork 190 about the axis Z.

Figure 8:
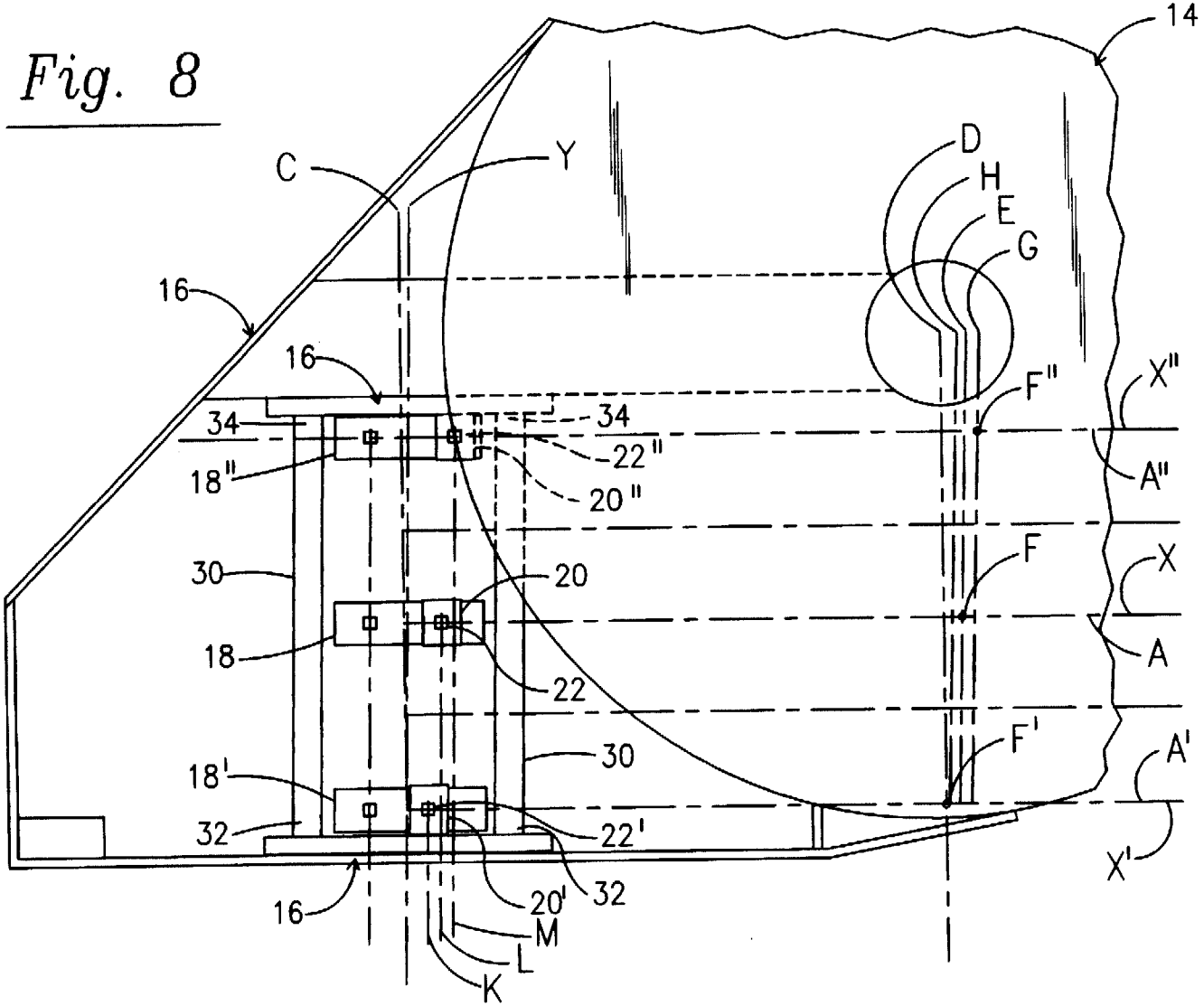
FIG. 8 is a schematic diagram illustrating three positions of the carriage and the base.

FIG. 8 is a schematic of the apparatus 10 illustrating three positions, of the plurality of positions available, of the base 18 as it travels along the first path Y. The radius line D of the turntable 14 extends from the center point of the turntable 14. When the portion of the frame 16 to which the guides 30 are attached is perpendicular to the radius D, line C is perpendicular to the frame and parallel to the radius D. The first path Y, which is also the centerline of the base 18, is angled at approximately 1½ degrees clockwise from centerline C. Therefore, the longitudinal axis of guides 30 are also at an angle of 1½ degrees with centerline C. When the tire 209 of the bicycle 12 contacts the turntable 14 at F' on radius D, movement of the base 18 along first path Y creates a locus of tire contact points that define a line H, which is parallel to the first path Y.

The rotational forces of the turntable 14 apply a lateral force to the tire 209 moving the contact point outwardly in relation to the center of the turntable 14 when the tire 209 contacts the turntable anywhere along line H. By moving the contact point ⅜ths of an inch rearward the locus of contact points define a line E. Along line E the rotational forces of the turntable 14 become neutral and no lateral forces are applied to the tire 209 so that the base 18 remains stationary. Moving the contact point an additional ⅜th of an inch or more rearward defines a locus of tire contact points that define a line G. The rotational forces of the turntable 14 apply a lateral force to the tire 209 moving the contact point inwardly in relation to the center of the turntable when the tire 209 contacts the turntable anywhere along line G.

When the contact point of the tire 209 lies along line H, the first support 22 is positioned along line K which is defined as a first unstable position of first support 22. When the contact point of the tire 209 lies along line G, the first support 22 is positioned along line M which is defined as a second unstable position of first support 22. When the contact point of the tire 209 lies along line E, the first support 22 is positioned along line L which is defined as a stable position of first support 22, and that stable position lies between the first unstable position and the second unstable position.

The lines H, E, and G are parallel to the first path Y, which lies at an angle of 1½ degrees with the axis C, therefore lines H, E and G lie at an angle of 1½ degrees with the radius D. This 1½ degree angle is a necessary adjustment to compensate for the changes in the lateral forces applied to the tire 209 as the tire 209 moves inwardly toward the center of the turntable 14.

As long as the first support 22 is positioned along line L, and the contact point between the tire 209 and the platform 14 lies along line E, the apparatus 10 remains stable and the base 18 will not move along the first path Y in either direction. This is illustrated in FIG. 8 where the base 18 is generally in a central position on the guides 30 along the first path Y.

If the carriage 20 and the support 22 are moved along the second path X, by rotation of the handlebars 211 in the counterclockwise direction, the first support 22 is moved forward into the first unstable position along line K, or beyond. The tire contact point F is moved forward to the line K, or beyond, and the base 18 then moves along the first path Y toward the first ends 32 of the guides 30. This movement will continue as long as the first support 22 remains in the first unstable position along the line K and the tire contact point is along or in front of line H. Movement of the base 18 can be stopped by centering the handlebars 211 so that the carriage 20 returns the first support 22 to the stable position or the base 18 moves to the first stop position defined as where the base 18 engages the frame 16 of the apparatus 10 proximal the first ends 32 of the guides 30. In FIG. 8, the base 18' is shown at the first stop position and the first support 22' in the unstable position along line K. The base 18' will continue to push against the frame 16 until the handlebars 211 are centered moving the carriage 20' along the second path X', which is generally coincident with the axis A' of the bicycle 12, so that the first support 22' is returned to the stable position along line L and the tire contact point F' thus lies along line E.

If the carriage 20 and the support 22 are moved along the second path X, by rotation of the handlebars 211 in the clockwise direction, the contact point F is moved rearward to the line G or beyond and the first support 22 moves into the second unstable position along line M. In the second unstable position, the base 18 moves inwardly along the first path Y toward the second ends 34 of the guides 30. Movement in this direction will continue as long as the first support 22 remains in the second unstable position along line M. Movement of the base 18 will be stopped by centering the handlebars 211 so that the carriage 20 returns the first support 22 to the stable position or when the base 18 reaches the second stop position, defined as where the base 18 engages the frame 16 of the apparatus 10 proximal the second ends 34 of the guides 30. The base 18" is illustrated in the second stop position and with the first support in the unstable position along line M. The base 18" will continue to push against the frame 16 until the handlebars 211 are centered moving the carriage 20" along the second path X", which is generally coincident with the axis A" of the bicycle 12, until the first support 22" is returned to the stable position along line L and the tire contact point F" thus lies along line E.

When the bicycle 12 is moved inwardly in relation to the turntable 14 increased effort is required to maintain the rotation of the tire 209 by pedaling the bicycle 12 and thus rotating the turntable 14. This is due to the moment arm becoming shorter as the tire contact point of the bicycle 12 moves closer to the center of the turntable 14. Of course, moving outwardly reduces the amount of effort required to maintain the same rate of rotation.

Since much of the training will be done at the same level of effort it is desirable that the first support 22 be easily maintained in the stable position. In that end, the exercise apparatus 10 further comprises a brake 213 for stopping movement of the base 18 along the first path Y when the first support 22 is in the stable position. As can be seen in FIG. 11, the brake 213 comprises a link 210 having a first end 212 and a second end 214. The link 210 is connected to the base 18. A braking surface 216 is attached to the second end 214 of the link 210 for engagement with guide 30. The link 210 is biased toward the engagement of the braking surface 216 with the guide 30 by a means for biasing the link, conveniently spring 218. The link 210 is inserted in a recess 220 formed in a side 222 of the base 18 along an axis line J that passes through the center of the guide 30, which in this embodiment is a cylindrical member. The spring 218 is longitudinally aligned along axis J and inserted within a cylindrical recess 223 formed in the base 18 along axis J. An element 224 having a first end 226 and a second end 228 is pivotally mounted to the side 222 of the base 18 proximal the recess 220 by pin 230. The element 224 is pivotally attached to the first end 212 of the link 210 by pin 232. As the element 224 rotates counter-clockwise about the pin 230 the link 210 moves along the recess 220 so that the link 210 compresses the spring 218 and moves the braking surface 216 so that it is spaced apart from the guide 30. As shown in FIG. 12, a groove 234 is formed in the bottom surface 236 of the carriage 20. When the first support 22 is in the stable position along line L, the first end 226 of the element 224 drops into a depression 238 within the groove 234 so that the spring 218 pushes the link 210 forward to engage the braking surface 216 with the guide 30. When the carriage 20 moves along the track 44 the first end 226 of the element 224 moves out of the depression 238 rotating the element 224 and retracting the link 210 moving the braking surface 216 away from engagement with the guide 30 so that the carriage 20 is free to move in either direction along the second path X.

The turntable 14 comprises a flat, generally circular platform 240, which is made from compressed particle board with a melamine layer 242 laminated to the top side 244 of the platform 240. Other suitable materials, including, but not limited to, metal and plastics may be used as a substitute material for the compressed particle board in which the platform 240 is constructed in a preferred embodiment. The cover 248 is constructed from polyurethane. The melamine layer provides a top surface 246 to the platform 240 that has a low coefficient of friction and is particularly satisfactory for interfacing with the polyurethane material so that the polyurethane material will move easily under lateral stress applied by the tire 209 reducing wear. The polyurethane material has a thickness of 1/16 of an inch and a Shore hardness value of 40. In other embodiments, other thicknesses may be used but the Shore hardness value must be adjusted accordingly to provide the correct amount of flexibility. For example, when a layer of 1/32 inch of polyurethane is used to form the cover 240, the Shore hardness value must be increased to 60 to prevent excessive stretching of the cover 240. Thin covers of polyurethane are less expensive, but thin covers are more susceptible to damage. Polyurethane is the preferred material for the cover 240 as it provides sufficient friction to prevent the bicycle tire 209 from slipping and yet allows minimal wear to the tire 209 that would be caused by the shear force generated on the tire 209 by the circular movement of the turntable 14 during rotation. The polyurethane deforms and follows the tire path, thus allowing insignificant wear to the tire 209. The melamine layer 242 provides an interface with a polyurethane cover 248 that has a low coefficient to friction enabling the cover 248 to deform. The cover 248 preferably extends over the edge 250. An elastic material 252, well known in the art, is attached to the edge of the polyurethane and extends around the edge 250 of the platform and under the platform to provide a tight fit.

Figure 9:
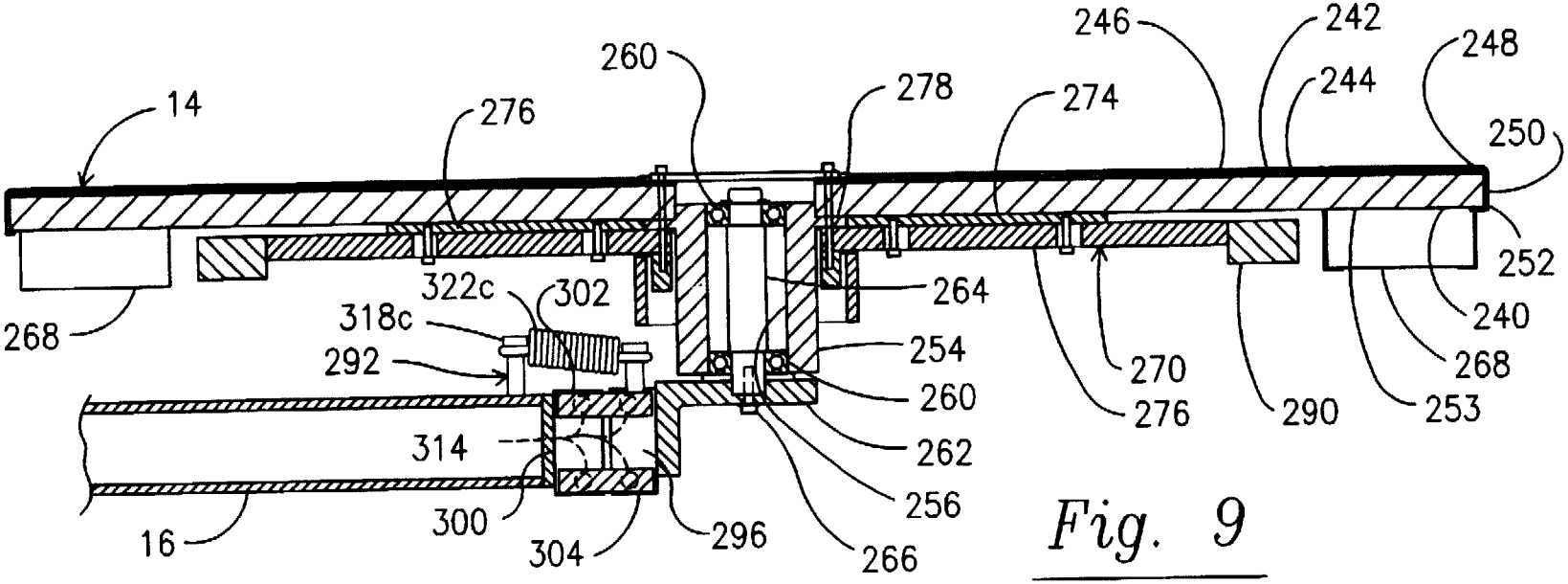
FIG. 9 is a detailed cross sectional view of the turntable and the lifting mechanism of the invention of FIG. 1.
Figure 10:
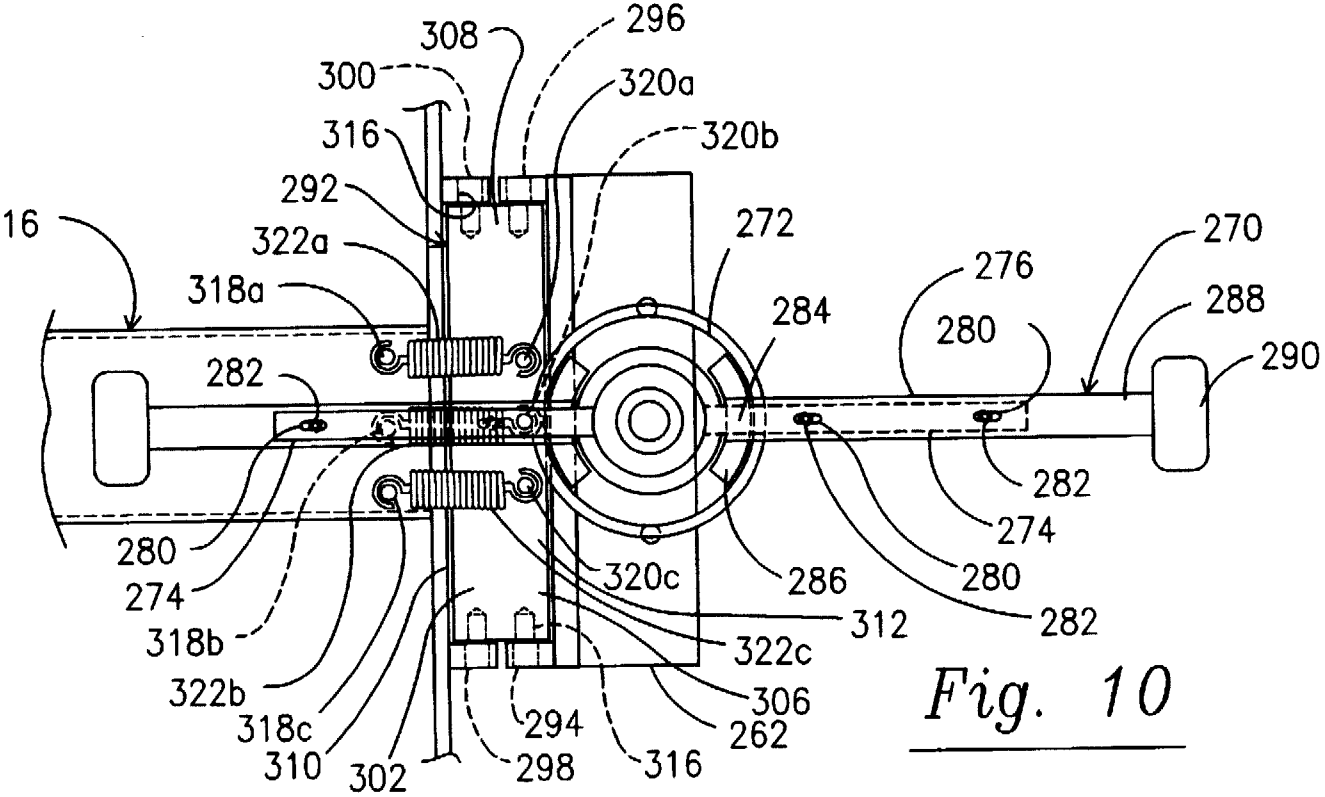
FIG. 10 is a top plan view of FIG. 9 with the turntable removed for clarity.
Figure 15:
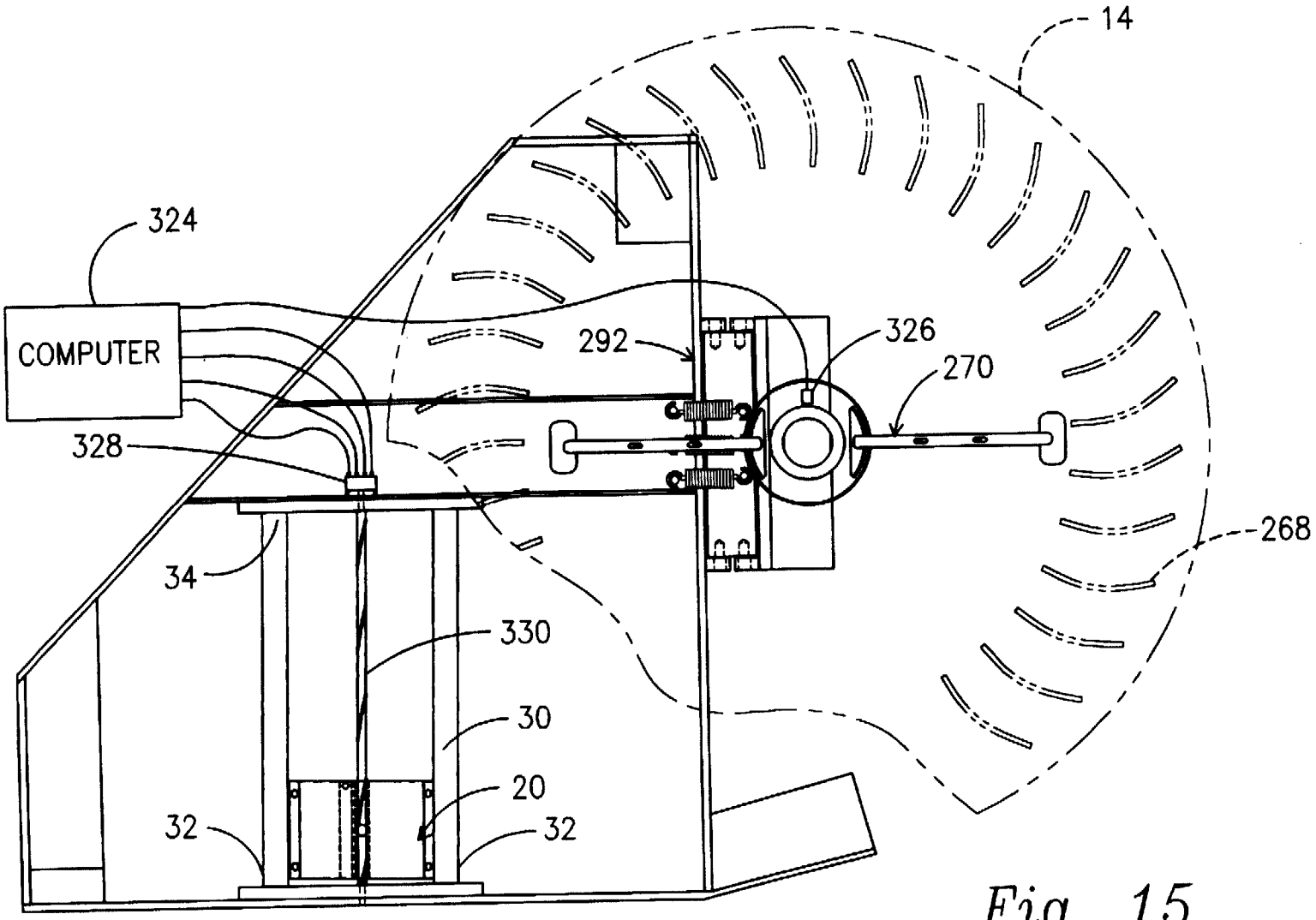
FIG. 15 is a detailed plan view of the invention of FIG. 1 illustrating the positioning of the sensors.

The turntable 14, as shown in FIGS. 9 and 10, further comprises a hub 254 with a hole 256 therethrough and a pair of bearings 260 installed by standard practice of those skilled in the art. The hub is attached to a turntable mount 262 by a turntable shaft 264 that is attached to the turntable mount 262 by a bolt 266. On the bottom surface 253 of the platform 240 are mounted a plurality of fan blades 268 (shown more clearly in FIG. 15) that channel air therebetween creating a resistance to rotation. In a preferred embodiment, as illustrated in FIGS. 9 and 15, there are 55 fan blades 268, that are attached by bolts, screws or other well known means. In other embodiments, a series of the fan blades 268 may be attached to a plate by welding and then the plate can be attached to the turntable 14. In a preferred embodiment each fan blade 268 has an arc of 120 degrees and a radius of curvature of approximately 2 inches. The fan blades are arranged so that when a radius extending from a center point of the turntable 14 passes through the end of a fan blade 268 proximal to the periphery of the turntable 14, the other end of the fan blade trails the radius line by ¼ inch. Many other configurations may be used to either increase or decrease the resistance to rotation as desired. The fan blades 268 are constructed from metal, but plastic or any other suitable material may be used, keeping in mind that reduction of the weight reduces the inertia and the exercise load.

In this embodiment, additional work load is created by a centrifugal brake 270 shown in FIGS. 9 and 10. The centrifugal brake 270 comprises a brake ring 272 that is mounted to the turntable mount 262 so that it remains stationary. Two centrifugal brake plates 274 are attached to the bottom surface 253 of the platform 240 by screws or other well known means. The brake plates 274 are to provide a means for attachment of the brake arms 276. The first end 278 of the brake plates lie proximal to the hub 254 and extend radially outwardly therefrom. The brake arms 276 each have two slotted holes 280 through which screws 282 are inserted for slidable attachment of the brake arms 276. The first end 284 of the brake arm has a brake pad 286 attached thereto for engagement with the brake ring 272. The second end 288 of each brake arm 276 has a weight 290 attached thereto. As the platform 18 rotates the weights 290 pull the brake arms 276 outwardly so that the brake pad 286 engages the brake to resist the rotation of the platform 240 and thus creates a requirement for increased effort by the cyclist to maintain the rate of rotation of the turntable 14. The faster the turntable rotates the greater the centrifugal force is applied to the weight 290 and the greater the pressure that is applied by the brake pad 286 to the brake ring 272.

In a preferred embodiment, as seen in FIGS. 9 and 10, a lifting force may be applied to the turntable 14 by a lifting device 292. The lifting device 292 comprises a first and a second leaf mount 298 and 300 respectively that are attached to the frame 16. A third and forth leaf mount 294 and 296 respectively are connected to the turntable 14. As shown in FIG. 10, leaf mounts 294 and 296 are attached to the turntable mount 262. As seen in FIG. 9, a first leaf 302 and a second leaf 304 are spaced apart from one another and are oriented generally parallel to one another. As seen in FIG. 10, the first leaf 302 has a first end 306, a second end 308, a first edge 310 and a second edge 312. A portion of the first end 306 and a portion of the second end 308 of first leaf 302 that are adjacent to the first edge 310 are pivotally attached to the first leaf mount 298 and the second leaf mount 300 respectively. Portions of the first end 306 and the second end 308 that are adjacent the second edge 312 are pivotally attached to the third leaf mount 294 and the forth leaf mount 296 respectively. The second leaf 304, seen more clearly in FIG. 9, is attached in the same manner to the first, second, third, and forth leaf mounts. The leaves 302 and 304 may be attached to the leaf mounts 294, 296, 298 and 300 by pins 314 that are inserted into the holes 316 through each leaf mount as shown in FIGS. 9 and 10. In the preferred embodiment, three posts **318*a*, 318*b* and 318*c* are attached to the frame 16. Three additional posts 320*a*, 320*b* and 320*c* are attached to the first leaf 302 adjacent the second edge 312. A biasing means, conveniently springs 322*a*, 322*b* and 322*c* extend between the posts 318*a* and 320*a*, 318*b* and 320*b* and 318*c* and 320*c*. The springs 322*a*, 322*b* and 322*c* are sized depending on the preferred upward force to be applied by the lifting device 292. In a preferred embodiment the springs 322*a*, 322*b* and 322*c* are sized to apply an upward force of 60 pounds against the bicycle tire 209**.

As seen in FIG. 15, in order to provide information to the user of the apparatus 10, a computer 324 is connected to sensors to collect data for calculation of distance traveled, work accomplished, speed and so forth. The computer 324 is connected to a sensor, a magnetic switch 326, that provides data to the computer with regard to the number of revolutions the turntable is making. When compared with the computers clock the computer can calculate the speed of rotation. The distance traveled will depend on the location of the contact point of the bicycle tire 209 with the turntable 14. This location provides data with regard to the resistance and the distance traveled. As shown in FIG. 15, a potentiometer 328 is connected electronically to the computer 324 and is connected to a spindle that is mounted at each end to the frame 16 by bearings (not shown). The spindle is generally rectangular in shape and is longitudinally twisted three of four revolutions. The spindle 330 passes through a hole 332 bored through the base parallel to the guides 30 so that as the base 18 moves along the guides 30 it also moves along the spindle 330. An obstruction is formed within the hole 332 so that as the base 18 moves along the spindle 330 it causes the spindle 330 to rotate. When the spindle is indexed in relation to the position of the base 18, for example 0 at the first stop position adjacent the first ends 32 of the guides 30, the computer can calculate the position of the base at any point along the spindle 330 and therefore, determine the point of contact of the tire 209 with the turntable 14 along E. While this is a preferred embodiment, any other similar means for sensing and locating the position of the contact point and the speed of rotation to determine the work load, distance and other like information may be used.

Having thus set forth a preferred construction for the exercise apparatus 10 for this invention, it is to be remembered that this is but a preferred embodiment. Attention is invited to a description of the use of the exercise apparatus 10. The apparatus 10 must be adjusted for the particular size wheel generally from 26–27 inches and the distance between the front axle and the rear axle of the bicycle 12. The front tire of the bicycle 12 is removed so that the fork drop outs 192 are free from the front wheel axle of the bicycle 12. The locking bolt 92 of the locking mechanism 80 is loosened so that the member 60 of the first support 22 is free to move on the post 68 to adjust the apparatus for differing wheel diameters. The bolt 164 is loosened so that the clamp 162 is free to slide on the bar 122. The bolts 143 are loosened so that the column clamp 141 is free to move along the beam 40. The T-bolts 118 are retracted toward the arms 106 so that the rear axle of the bicycle can be positioned therebetween. The bicycle 12 is now placed with its rear wheel on the turntable 14 so that the fork drop outs 192 may engage the threaded shaft 186 that extends from the spacer 178 of the actuator 160. The bolts 188 are then tightened to attach the fork 190 to the actuator 160. The member 60 is lowered to the bottom position and then raised until the cup shaped receptors 120 engage the nuts on the rear axle of be the bicycle 12. The T-bolts 118 are tightened on either side to ensure that the bicycle remains centered along axis A. The second support 24 moves up and down in tandem with the first support 22 due to the rod 150 that is attached to the member 60 and passes through the hole 144 in the sleeve 132.

The base 18 is moved to the first stop position, where the base 18 is adjacent to the first ends 32 of the guides 30. The carriage 20 is positioned on the base 18 so that the brake is engaged and the base 18 is prevented from moving along first path Y. The contact point of the bicycle tire 209 is located ⅜ inch to the rear of the radius line D, that is, along line E as shown in FIG. 8. The first support 22 is then raised so that the tire 209 is just barely contacting the turntable 14. The locking bolt 92 is then tightened and bolts 164 and 143 are also tightened after centering the bicycles handlebars 211, so that if a front tire were attached to the bicycle 12 the bicycle would travel in a straight line. The gas cylinder 104 having compensated for the weight of the bicycle permits easy adjustment of the member 60 by the rider.

A rider may now mount the bicycle and begin pedaling causing the turntable to rotate in the counterclockwise direction. If the rider wishes to increase the resistance he turns the handlebars 211 to the right, which actuates the actuator 160. Rotation of the handlebars 211 to the right causes the first strut 156 to move rearward moving the first support 22 rearward on the track 44 along the second path X. The first support 22 is now in an unstable position the braking surface has been removed from contact with the adjacent guide 30 freeing the base 18 to move inwardly. As shown in FIG. 8, the contact point of the tire 209 now lies along line G and the bicycle continues to move inwardly until the rider centers the handlebars and the braking surface 216 is reengaged. Upon centering the handlebars the first strut 154 is moved forward until the support 22 is in the stable position, along line L, and the tire contact point rests on line E.

If the rider wishes to reduce the effort required to pedal, the rider turns the handlebars to the left pulling the first strut 154 forward and pulling the first support 22 forward until the first support 22 is in the first unstable position and the contact point of the tire 209 is along line H. In this unstable position with the braking surface 216 spaced apart from the guide 30, the base 18 moves to the left toward the first ends 32 of the guides 30. In this fashion, the cyclist may easily control the amount of work accomplished per unit time. The rider may reduce the pedaling effort and rely on the inertia of the turntable 14 to obtain the sensation of coasting, thus giving the true sensation of outside biking.

It will thus be seen that the object set forth above among those made apparent from the preceding description, are efficiently attained, and since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, may be said to fall between.

Now that the invention has been described.

What is claimed:

1. An exercise apparatus for use in combination with at least a portion of a bicycle, that has a body, a front fork pivotally attached to the body, handlebars attached to the fork, a wheel attached to the body, and pedals operatively connected to the wheel, said apparatus comprising:

a frame;

a turntable rotatably connected to said frame;

a base attached to said frame adjacent to said turntable for movement of said base along a first path between a first stop position and a second stop position;

a carriage attached to said base for movement along a second path, a first support attached to said carriage, said first support being configured for attachment of at least a portion of a bicycle thereto so that when a bicycle is mounted on said first support a wheel of the bicycle is engagable with said turntable; and means for moving said carriage along said second path between a first unstable position and a second unstable position, and said first support being positionable at a stable position lying therebetween, whereby when the bicycle is mounted on said support with a wheel of the bicycle contacting said turntable and with said first support lying proximal said first unstable position, said base moves along said first path toward said first stop position, and when said first support lies proximal said stable position said base remains generally motionless, and when said first support lies proximal said second unstable position said base moves along said first path toward said second stop position.

2. An exercise apparatus as in claim 1, said means for moving said first support between said first unstable position and said second unstable position comprising:

a first strut having a first end and a second end, said first end being connected to said first support;

an actuator attached to said second end of said first strut and said actuator being configured for attachment of a front fork of the bicycle thereto and holding said fork so that an axis extending through said fork remains generally stationary in relation to said frame so that pivoting the front fork about said axis of said fork moves said first support between said first unstable position and said second unstable position.

3. An exercise apparatus as in claim 2, said actuator comprising:

a first plate to which is mountable the front fork of a bicycle, said plate being pivotally attached, at a first pivot point, to said first strut;

a second plate pivotally attached to said first plate at a second pivot point that is spaced apart from said first pivot point;

a second strut having a first end and a second end, said first end being attached to said second plate; and a second support attached to said frame and being attached to said second end of said second strut, whereby pivoting the front fork of a bicycle that is attached to said first plate, pivots said first plate in relation to said second plate about said second pivot point, thereby moving said first strut so that said first support is moved along said second path.

4. An exercise apparatus as in claim 1 further comprising:

means for selectively providing an upward force to said turntable that is attached to said frame and connected to said turntable.

5. An exercise apparatus as in claim 4 wherein said means for selectively providing an upward force to said turntable comprises:

a first and a second leaf mount attached to said frame and a third and a fourth leaf mount connected to said turntable;

a first leaf and a second leaf spaced apart from one another and generally parallel to one another, each said leaf having a first end and a second end, a first longitudinal edge and a second longitudinal edge, said first and second ends of said first leaf being pivotally attached to a corresponding one of said first and second leaf mounts, said first and second ends of said second leaf, being pivotally attached to a corresponding one of said first and second leaf mounts, said first and second ends of said first leaf, being pivotally attached to a corresponding one of said third and fourth leaf mounts, and said first and second ends of said second leaf being pivotally attached to a corresponding one of said third and fourth leaf mounts; and a biasing means connected to said frame and connected to said first leaf adjacent to said second longitudinal edge of said first leaf such that said second longitudinal edge of said first and second leaves are selectively biased to pivot in an upward direction, whereby said third and fourth leaf mounts and said connected turntable are selectively biased for generally upward vertical movement.

6. An exercise apparatus as in claim 1 wherein each said turntable has a top surface and a peripheral edge, each said turntable comprising:

a cover lying adjacent said top surface and being attached to said peripheral edge of said turntable, said cover being comprised of polyurethane.

7. An exercise apparatus as in claim 6 wherein the polyurethane material of said cover has a durometer reading of generally 40 on the shore scale for a thickness of said cover of generally one sixteenth of an inch.

8. An exercise apparatus as in claim 6 wherein the polyurethane material of said cover has a durometer reading of generally 60 on the shore scale for a thickness of said cover of generally one thirty-second of an inch.

9. An exercise apparatus as in claim 6 wherein said top surface of each said turntable is comprised of a smooth surface having a low coefficient of friction.

10. An exercise apparatus as in claim 1 wherein said base further comprises a brake for stopping movement of said base along said first path when said first support is in said stable position.

11. An exercise apparatus as in claim 10 wherein said frame comprises a pair of guides supporting said base for movement of said base along said first path, and wherein said carriage has a bottom surface and said brake comprises:

a link having a first end and a second end, said link being connected to said base;

a braking surface attached to said second end of said link;

means for biasing said link toward engagement of said braking surface with one of said pair of guides, said biasing means engaging said base and said first end of said link;

an element having a first end and a second end, said first end being pivotally attached to said base and said element being pivotally attached to said first end of said link such that said first end of said element engages said bottom surface of said carriage; and said bottom surface of said carriage having a slot formed therein such that when said first support is in said stable position said second end of said element is received by said slot so that said braking surface engages said one guide.

12. An exercise apparatus as in claim 1, wherein said first support comprises;

a hollow member having an interior surface, a first end, that is closed, and a second end, that is open;

a post having a first end attached to said carriage, and a second end that is slidably received by said second end of said member, said post further comprising a lock for locking said interior surface of said member to said post, means for biasing said second end of said sleeve away from said first end of said post when said sleeve is locked to said post.

13. An exercise apparatus as in claim 12 wherein said first support further comprises a pair of arms, each arm having a first end and a second end, said first end of each said arm being connected to said first support and said second end of each said arm being configured for attachment to a bicycle proximal the rear wheel of the bicycle, whereby a bicycle is mounted on said exercise apparatus.

14. An exercise apparatus as in claim 12 wherein said second support further comprises;

a column having a first end and a second end, said first end being attached to said base and said second end extending upwardly therefrom;

a sleeve having an open first end that is sized and configured to receive said first end of said column therein and said second end of said second strut being attached to said sleeve; and a connector having a first end attached to said member of said first support and a second end engaging said sleeve, such that said sleeve moves correspondingly on said column as said member moves on said post.

* * * * *